US010632772B2

(12) United States Patent
Persons et al.

(10) Patent No.: US 10,632,772 B2
(45) Date of Patent: Apr. 28, 2020

(54) FLUID APPLICATION SYSTEM AND METHOD

(71) Applicant: GED Integrated Solutions, Inc., Twinsburg, OH (US)

(72) Inventors: Matthew B. Persons, Akron, OH (US); Michael Novik, Moreland Hills, OH (US); Timothy B. McGlinchy, Twinsburg, OH (US)

(73) Assignee: GED Integrated Solutions, Inc., Twinsburg, OH (US)

( * ) Notice: Subject to any disclaimer, the term of this patent is extended or adjusted under 35 U.S.C. 154(b) by 0 days.

(21) Appl. No.: 15/807,120

(22) Filed: Nov. 8, 2017

(65) Prior Publication Data

US 2018/0065388 A1 Mar. 8, 2018

Related U.S. Application Data

(62) Division of application No. 15/225,039, filed on Aug. 1, 2016, now Pat. No. 9,849,701, which is a division (Continued)

(51) Int. Cl.

*B41J 11/00* (2006.01)
*B41J 25/00* (2006.01)

(Continued)

(52) U.S. Cl.

CPC ..... *B41J 25/001* (2013.01); *B41J 3/28* (2013.01); *B41J 11/007* (2013.01); *B41J 11/06* (2013.01)

(58) Field of Classification Search

CPC . B41J 3/387; B41J 11/06; B41J 11/007; B41J 13/08; B65H 5/08; B65H 5/085;

(Continued)

(56) References Cited

U.S. PATENT DOCUMENTS 3,340,820 A 9/1967 Poisson
3,476,231 A 11/1969 Bower (Continued)

FOREIGN PATENT DOCUMENTS

EP 0876107 7/2002
EP 2033783 3/2009

(Continued)

OTHER PUBLICATIONS

International Search Report dated Oct. 4, 2013 and Written Opinion of the International Searching Authority dated Oct. 4, 2013 for PCT International Application No. PCT/US2013/041973, filed May 21, 2013. (12 pages).

(Continued)

*Primary Examiner* — Scott A Richmond
(74) *Attorney, Agent, or Firm* — Tarolli, Sundheim, Covell & Tummino LLP; John A. Yirga, Esq.

(57) ABSTRACT

A fluid application system and method having a support structure for guiding a plurality of pallets along a path of travel through the system. The plurality of pallets for arranging a medium that receives fluid during operation. The system further includes an application assembly for applying fluid and energy to a medium arranged on the plurality of pallets and a conveyance arrangement comprising first and second conveyors for transferring the one or more pallets through the fluid application system. The first and second conveyors have a dedicated trolley selectively coupled to one of the plurality of pallets during movement along a first direction of the path of travel and selectively decoupled from the one of the plurality of pallets during movement along a second direction of the path of travel.

22 Claims, 11 Drawing Sheets

Related U.S. Application Data of application No. 13/897,565, filed on May 20, 2013, now Pat. No. 9,421,794.

(60) Provisional application No. 61/649,545, filed on May 21, 2012.

(51) Int. Cl.
*B41J 3/28* (2006.01)
*B41J 11/06* (2006.01)

(58) Field of Classification Search
CPC ... B65H 5/10; B65H 5/12; B65H 5/14; B65H 25/00; B65H 25/02; B65H 25/04
See application file for complete search history.

(56) References Cited

U.S. PATENT DOCUMENTS

| | | | | |
|---|---|---|---|---|
| 3,973,672 | A | 8/1976 | Frost | |
| 4,530,287 | A | 7/1985 | Sticht | |
| 5,384,586 | A | 1/1995 | Hirano et al. | |
| 5,533,445 | A | 7/1996 | Bill | |
| 7,363,856 | B1 | 4/2008 | Moulin | |
| 9,849,701 | B2 | 12/2017 | Persons et al. | |
| 2005/0002005 | A1* | 1/2005 | Terada | G03F 7/70383 355/53 |
| 2008/0251354 | A1 | 10/2008 | Ruggaber et al. | |
| 2009/0090257 | A1 | 4/2009 | Feldman et al. | |
| 2009/0244243 | A1* | 10/2009 | Nakagawa | B41J 3/28 347/104 |
| 2010/0200371 | A1 | 8/2010 | Reuteler | |

FOREIGN PATENT DOCUMENTS

| | | |
|---|---|---|
| EP | 2127889 | 12/2009 |
| GB | 2457098 | 8/2009 |
| WO | WO 2008062939 | 5/2008 |
| WO | WO2010/035263 | 4/2010 |

OTHER PUBLICATIONS

Extended European Search Report dated Sep. 16, 2016. (10 pages).
Canadian Examination Report dated Jun. 1, 2018 in corresponding Canadian Application No. 2,874,027. (4 pages).
Canadian Office Action dated Mar. 25, 2019 for Application No. 2,874,027.

* cited by examiner

FLUID APPLICATION SYSTEM AND METHOD

CROSS REFERENCE TO RELATED APPLICATIONS

The present application is a divisional application claiming priority under 35 U.S.C. § 121 to U.S. nonprovisonal application Ser. No. 15/225,039 that was filed on Aug. 1, 2016 and published on Nov. 24, 2016 under publication number US-2016-0339723, which was a divisional application claiming priority under 35 U.S.C. § 121 to U.S. nonprovisional application Ser. No. 13/897,565 filed May 20, 2013, which claims priority under 35 U.S.C. 119(e) to provisional application Ser. No. 61/649,545 filed on May 21, 2012. Priority is claimed to all of the above-identified applications and publications, which all are also incorporated herein by reference in their entireties for all purposes.

TECHNICAL FIELD

The present disclosure relates to a fluid application system and method, and more particularly, a fluid application system that applies fluid with high precision placement on various types of mediums.

BACKGROUND

Conventional inkjet or swath printers typically reproduce an image by ejecting small drops of ink from a print head or array of print heads. Each head typically comprises a plurality of spaced apart nozzles. The ink nozzles in common multicolor applications contain a combination of clear, white, cyan, magenta, yellow, and black ("CMYK") ink for dispensing on a medium such as paper. While monochrome ink nozzles commonly contain only some combination of clear, white and black.

The small ink drops are strategically positioned at selected locations along a horizontal and vertical grid programmed over the medium. Swath printers may use multiple passes to print an image. Each pass may result in ink being applied within a designated area by more than one nozzle in an array of a single print head or different print heads.

The multiple passes may result in the ink that is applied in the designated area to be next to or partially overlapping the already printed swath. During each pass of the print head or heads, the medium is typically advanced a selected amount relative to the print head for creating the desired image.

SUMMARY

One example embodiment of the present disclosure includes a fluid application system comprising a support structure for guiding a plurality of pallets along a path of travel through the fluid application system. The plurality of pallets for arranging a medium that receives fluid during operation. The system also comprises an application assembly for applying fluid and energy to a medium arranged on the plurality of pallets. The application assembly translates during operation in an application direction transverse to the path of travel. The system also includes a conveyance arrangement comprising first and second conveyors for transferring the plurality of pallets through the fluid application system. The first and second conveyors having a dedicated carrier selectively coupled to one of the plurality of pallets during movement along a first direction of the path of travel and selectively decoupled from the one of the plurality of pallets during movement along a second direction of the path of travel.

Another example of the present disclosure comprises an ink dispensing system having a support structure for gliding a plurality of pallets along a path of travel through the ink application system. The plurality of pallets arrange a medium that receives ink during operation. The ink dispensing system further comprises an application assembly for applying ink and energy to a medium arranged on the plurality of pallets, the application assembly translating during operation in an application direction transverse to the path of travel. The ink system further comprises a conveyance arrangement comprising first and second conveyors, each for transferring one of the plurality of pallets through the fluid application system. First and second conveyors have a dedicated carrier selectively coupled to one of the plurality of pallets during movement along a first direction of the path of travel and selectively decoupled from the one of the plurality of pallets during movement along a second direction of the path of travel. The first and second conveyors further comprising extending to an entry station and an exit station of the ink dispensing system, allowing for prescribed coupling and decoupling of the dedicated carriers with alternating pallets such that the ink is applied between the plurality of pallets without interruption during operation.

Yet another example embodiment of the present disclosure comprises a method of applying ink and energy from an ink dispensing system to a medium. The method comprises the steps of guiding a plurality of pallets across a support structure along a path of travel through the ink dispensing system and arranging a medium that receives ink during operation along a receiving surface of the plurality of pallets. The method also comprises translating an application assembly in a direction transverse to the path of travel, the application assembly applying ink and energy to the medium arranged on the plurality of pallets. The method further comprises transferring the plurality of pallets through the fluid application system with a conveyance arrangement comprising first and second conveyors and dedicating a carrier to each of the first and second conveyors. The dedicated carriers are selectively coupled to alternating one of the plurality of pallets during movement along a first direction of the path of travel and selectively decoupled from the alternating one of the plurality of pallets during movement along a second direction of the path of travel such that the ink and energy is applied between the plurality of pallets without interruption of the ink and energy application to the medium located on differing pallets of the plurality of pallets.

BRIEF DESCRIPTION OF THE DRAWINGS

The foregoing and other features and advantages of the present disclosure will become apparent to one skilled in the art to which the present invention relates upon consideration of the following description of the invention with reference to the accompanying drawings, wherein like reference numerals refer to like parts unless described otherwise throughout the drawings and in which.

DETAILED DESCRIPTION

Referring now to the figures generally wherein like numbered features shown therein refer to like elements throughout unless otherwise noted. The present disclosure relates to a fluid application system and method, and more particularly, a fluid application system that applies fluid with high precision placement on various types of mediums.

Figure 1:
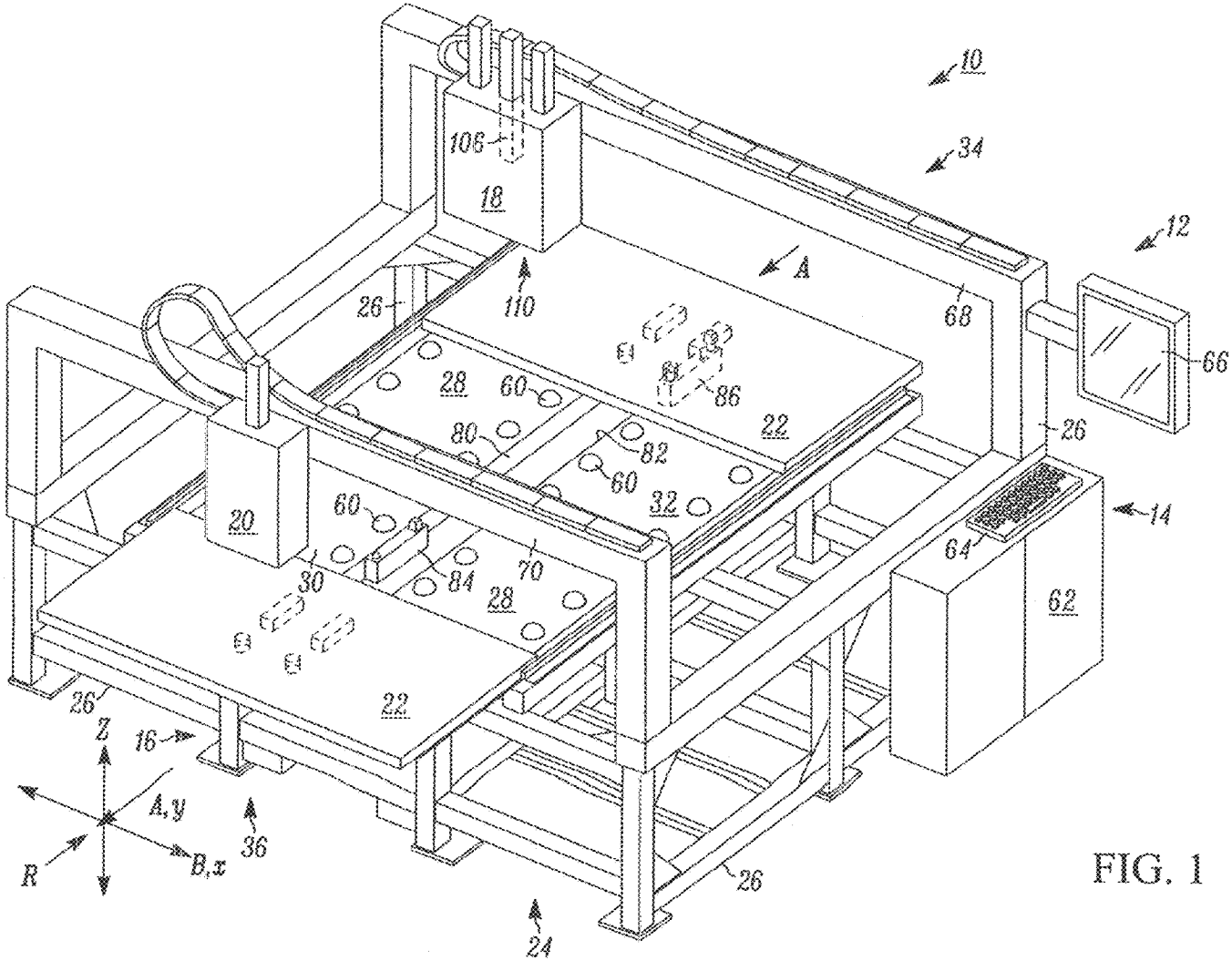
FIG. 1 is perspective view of a fluid application system constructed in accordance with one example embodiment of the present disclosure.
Figure 2:
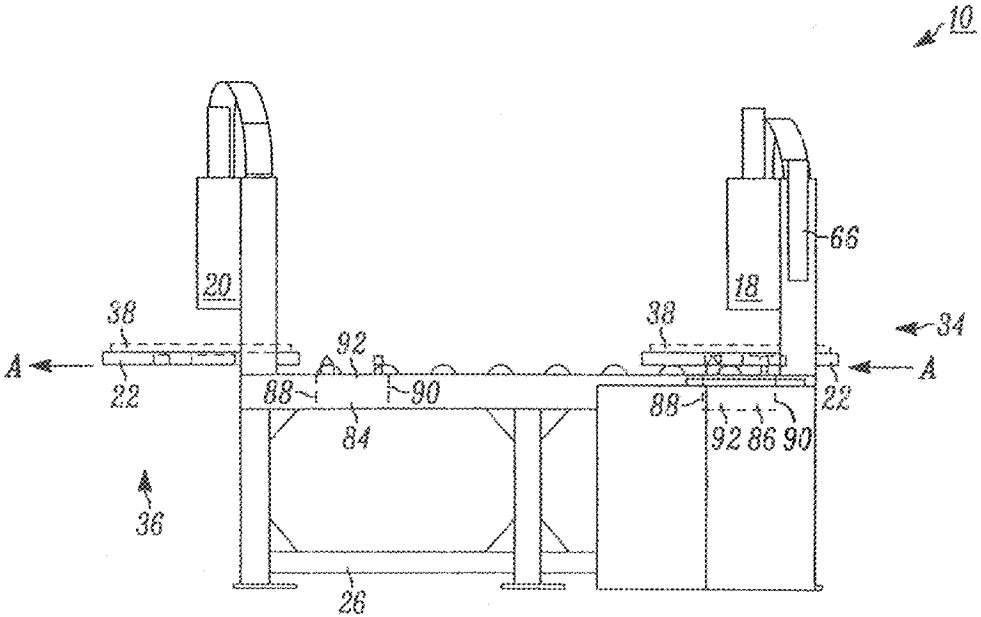
FIG. 2 is a side elevation view of FIG. 1.

FIG. 1 illustrates a perspective view of a fluid application system 10 constructed in accordance with one example embodiment of the present disclosure. The fluid application system 10 comprises a support structure 12, control system 14, conveyance arrangement 16, application assembly 18, curing structure 20, and plurality of pallets 22.

The support structure 12 comprises a frame 24 including a plurality of fixtures 26 in both a vertical and horizontal direction welded or connected together by conventional fasteners. The fixtures 26 in the illustrated example embodiment are three sixteenths of one-inch thick structural steel, but could be made of other materials having similar strength characteristics. This design and size of the support structure 12 is such to minimize deflection along the z-axis. In the illustrated example embodiment, the support structure 12 is precision edge referenced to minimize deflection and guarantee accuracy, such that deflection along the z-axis at any point is less than 0.005" inches.

The frame 24 includes a table 28 divided by first and second paths 30, 32, respectively. The first and second paths 30, 32 extend from an entry station 34 to an exit station 36 along centrally located longitudinal axis indicated by arrows A.

The plurality of pallets 22 are loaded into the system 10 at the entry station 34 via manual or automatic loading (not shown) and continue to pass along a path of travel (A) defined by arrows A until reaching the exit station 36 where the pallets are manually or automatically unloaded (not shown). In the illustrated example embodiment, the plurality of pallets 22 are each approximately six feet long, three feet wide, and one inch thick, formed from a metal weldment, such as aluminum or steel. However, it should be appreciated that other pallet sizes and material (such as hard plastic) are intended to be within the scope of the claimed disclosure.

Figure 4:
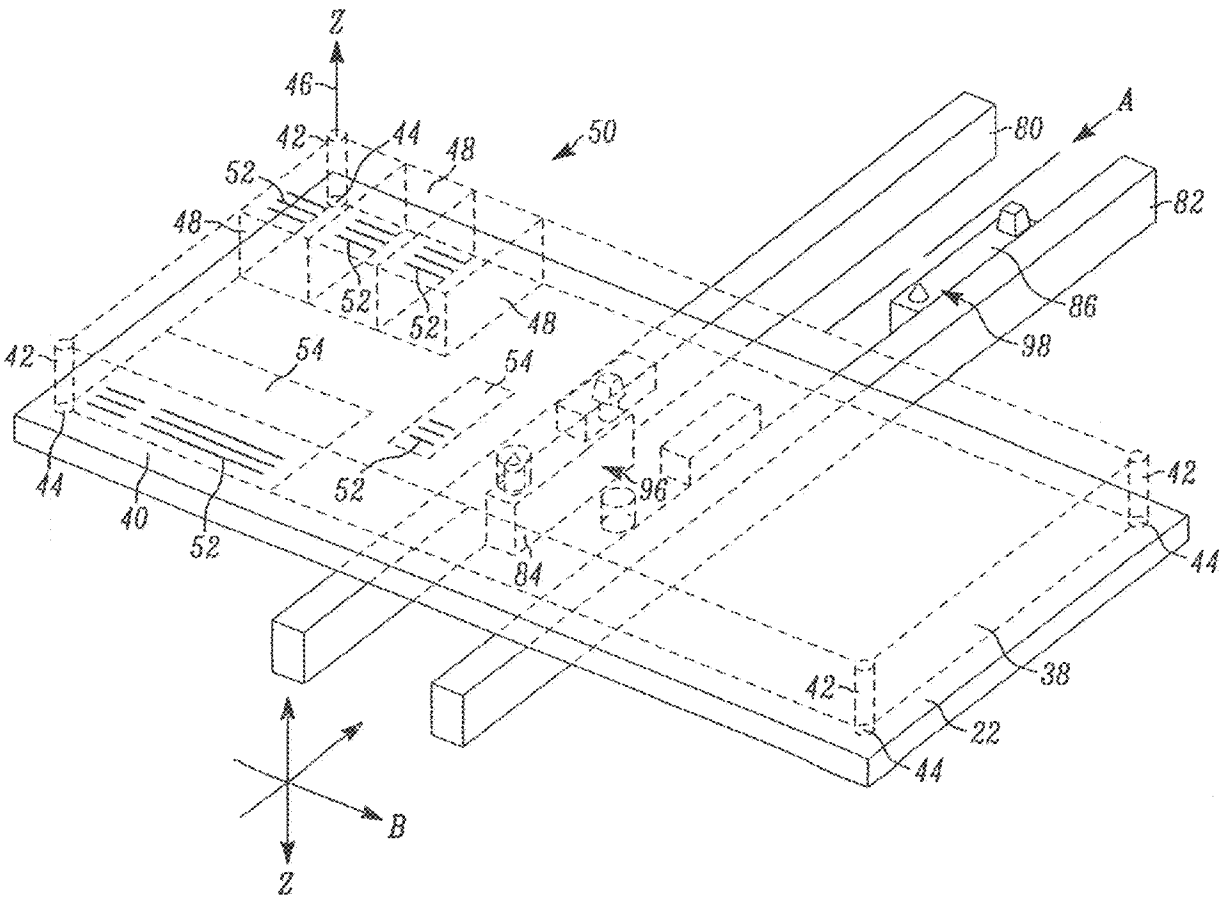
FIG. 4 is a partial perspective view of a conveyance arrangement constructed in accordance with one example embodiment of the present disclosure.
Figure 5:
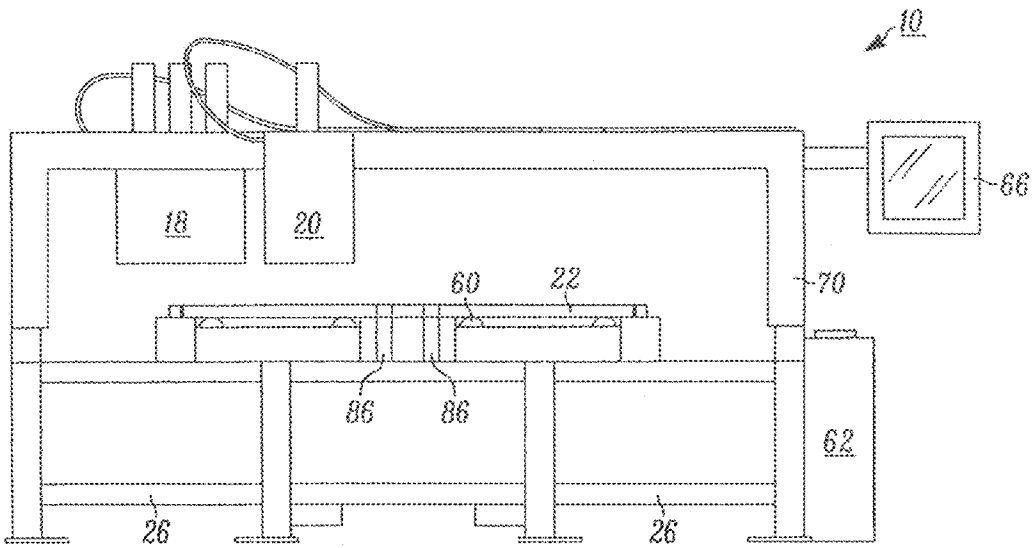
FIG. 5 is a front elevation view of FIG. 1.

FIG. 4 is a partial perspective view of the conveyance arrangement 16 constructed in accordance with one example embodiment of the present disclosure, supporting a pallet 22. The pallet 22 in one example embodiment supports a jig 38 (shown in phantom) that precisely positioned on a work surface 40, by for example one or more dowel pin 42 location holes 44 in the pallet. In the illustrated example embodiment, a datum or home position 46 is referenced from one of the location holes 44 for programming by the control system 14.

The jig 38 precisely locates various media 50 on the pallet 22 for receiving fluid or ink 52 from the application assembly 18. In one example embodiment, the media 50 comprises metal or paper objects 48 (e.g. boxes), where ink or fluid 52 is applied to their top surface, as shown in FIG. 4. In another example embodiment, the media 50 comprises steel sheets, paper sheets, and/or non-corrugated cardboard (collectively 54), as also illustrated in FIG. 4, with ink 52 being applied to their top surface. It should be appreciated that the system 10 can apply ink 52 to all types of media 50 described at the same time or allocated on/in a single jig 38. In another alternative example embodiment, the media 50 is flat or curved plastic, metal, and/or paper positioned on the pallet 22 without a jig 38 or in a recess formed within the pallet during the application of fluid 52.

It should be appreciated that as objects 48 flat media 54 receive fluid 52 from the system 10, the application assembly 18 travels up and down along the z-axis. In one example embodiment, the print heads 112 must be within at least 1.5 mm of the objects 48 and 54 during the application of fluid 50 to the media 52.

Referring again to FIG. 1, the table 28 comprises a plurality of ball transfers 60 that allow the pallets 22 to possess a controlled float from the entry end 34 to the exit end 36. One suitable example of the ball transfers 60 in the illustrated example embodiment is part number 6460k32 sold by McMaster-Carr located in Aurora, Ohio. In an alternative example embodiment, cylindrical bearings are used in place of the ball transfers.

The control system 14 comprises a user interface 62 such as a computer, PLC, and the like with an interactive keyboard 64 and monitor/touch screen 66. The control system 14 is programmed to control the coupling and decoupling of the pallets 22 from the conveyance arrangement 16. The control system 14 further controls the longitudinal movement of the pallets 22 and medium thereon along the path of travel A, as well as the lateral movement of the application assembly 18 and curing structure 20 about the lateral axis B. The control system 14 in another example embodiment also controls the axial movement along the z-axis of the application assembly 18 and curing structure 20 near and away from the pallets 22 and media 50 thereon.

Lateral and longitudinal movement of the application assembly 18 and curing structure 20 occurs across respective catwalks or bridges 68, 70. Such movement along the catwalks 68, 70 and in the z-axis of the application assembly 18 and curing structure 20 is achieved in the illustrated example embodiment by double action linear actuators such as cylinders. However, it should be appreciated that movement could occur by other modes of translation such as a ball screw and the like.

The curing assembly 20 provides energy to the media 50 for curing the ink after being applied to the media by the application assembly 18. In the illustrated example embodiment, the curing assembly is an ultraviolet (UV) light commercially made by Integration Technology located in Chicago, Ill. under model number Subzero 170. It should be appreciated that other supplemental curing assemblies could be used in addition to UV lights without departing from the claims of the present disclosure. For example, resistant heating is another structure that could be incorporated into the curing assembly.

Figure 3:
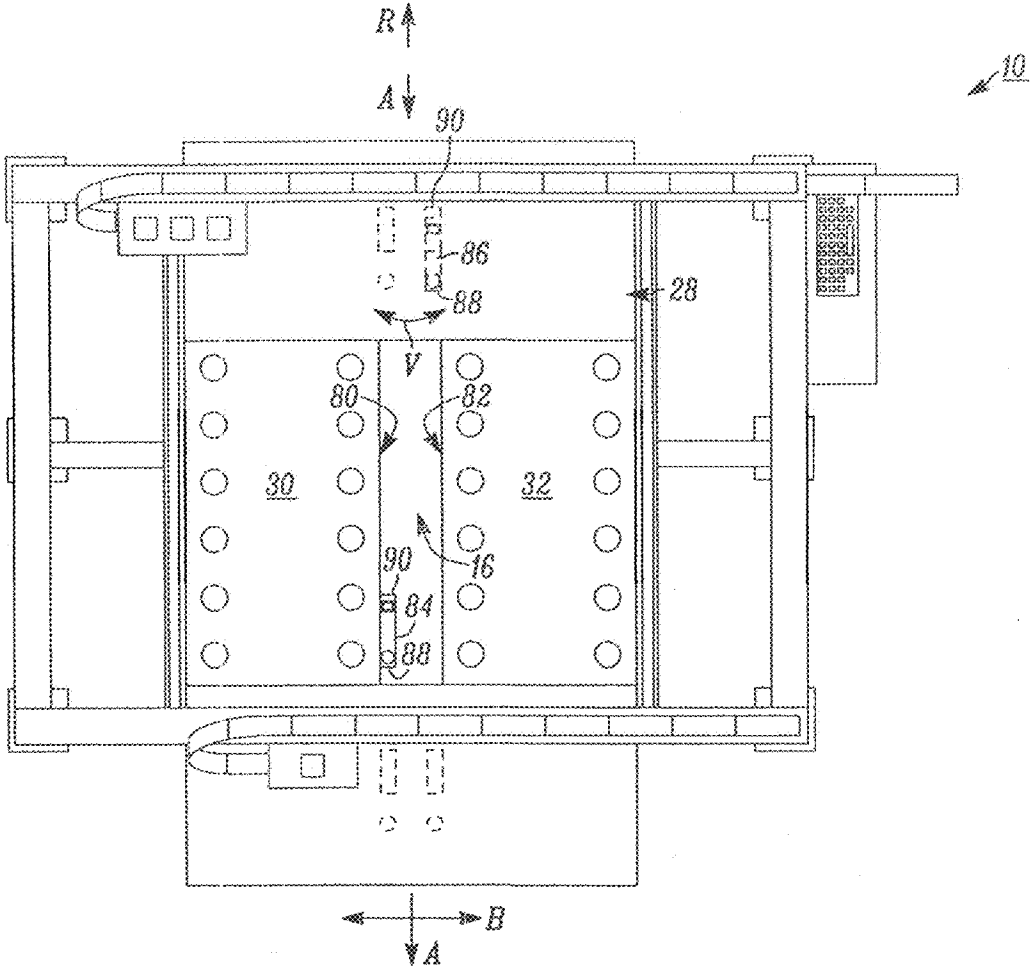
FIG. 3 is a top plan view of FIG. 1.

Extending parallel along the first and second paths 30, 32 of the table 28 is the conveyance arrangement 16, as best seen in FIG. 3. The conveyance arrangement 16 comprises first and second conveyors 80, 82 respectively for translating dedicated carriers or trolleys 84, 86 longitudinally back and forth along the path of travel A. The dedicated carriers 84, 86 are selectively coupled and decoupled as programmed by the control system 14 to one of the plurality of pallets 22 during movement of the pallets and media 50 thereon through the application system 10.

In the illustrated example embodiment, first and second conveyors 80, 82 are linear motors, providing precise indexing (forward longitudinal movement of the pallets 22 during the dispensing of fluid or ink 52 by the application assembly 18) of the dedicated carriers or trolleys 84 and 86 while coupled to the pallets along the path of travel A. In one example embodiment, the linear motor conveyors 80, 82 have a positioning tolerance through a respective encoder of 1μ (micron) on each carrier 84, 86 along the 10-foot path of travel A. One example of suitable linear motors forming conveyors 80, 82 are linear motors manufactured by Allen Bradley of Milwaukee, Wis. under part number MPAS-A9194K-ALM02C.

The conveyors 80, 82 also return the dedicated carriers 84, 86 in a direction (or return path indicated by arrows R in FIG. 1) opposite the path of travel A, namely from the exit station 36 to the entry station 34 when decoupled from the pallets 22. The dedicated carriers 84, 86 include a leading side 88 and trailing side 90 consistent with the movement of the pallet 22 and carriers along the path of travel A.

The carriers 88, 86 comprise a linear actuator 91, such as a solenoid or pneumatic cylinder coupled to a conical pilot 92 having a ground conical surface (GCS) (ground to a tolerance of +/−0.0001 inches) made from hardened steel and a hardened steel rudder 94, both selectively concomitantly or individually movable between an advanced actuated position 96 and a retracted actuated position 98, as illustrated in FIG. 4. The pallets 22 further comprise a centering pilot 100 and guiding pilot 102 recessed into an undercarriage surface 104 of the pallets 22. The centering pilot 100 is for receiving the conical pilot 92 and the guiding pilot 102 is for receiving said rudder 94 during the advanced actuated position 96, coupling the pallet 22 to the carriers 84, 86, as best seen in FIGS. 10 and 11.

Figure 10:
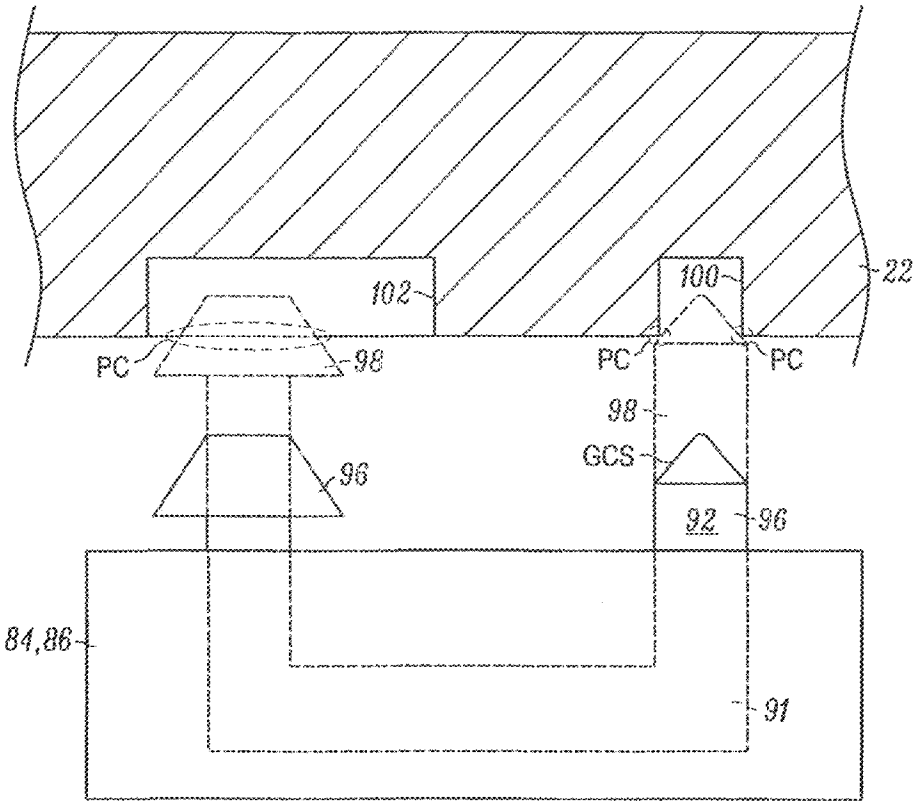
FIG. 10 illustrates a portion of the conveyance arrangement under and and engaging a portion of a pallet in accordance with one example embodiment of the present disclosure.
Figure 11:
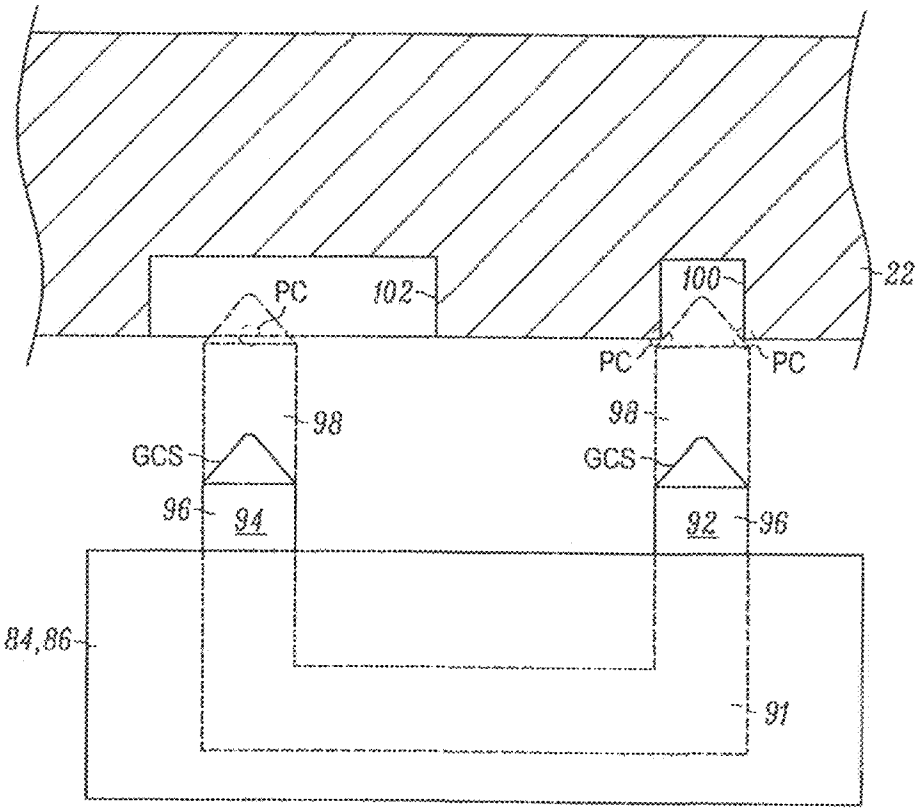
FIG. 11 illustrates a portion of the conveyance arrangement under and engaging a portion of a pallet in accordance another example embodiment of the present disclosure.

The conical pilot 92 when actuated to the advanced actuated position 98 into the centering pilot 100 engages an annular point of contact (PC) around the GCS, without bottoming out within the pilot 92, as illustrated in FIGS. 10 and 11. The pallet 22 as a result is centered along the table 28, and more particularly the application system 10 to a known position within +/−0.0001" inches, eliminating slack between the earners 84, 86 and the pallets 22, during movement through the control system 14 about the longitudinal axis y and lateral axis x. The redder 94 when actuated into the advanced actuated position, orients the pallet 22 from lateral rotation as indicated by arrows V in FIG. 3 by engaging the guiding pilot at a point of contact or side of contact (PC) along the sides of the obround slot as illustrate in FIGS. 10 and 11 before the rudder bottoms out in the pilot.

The centering pilot 100 in the illustrated example embodiment is a center ground conical recess. In an alternative example embodiment illustrated in FIGS. 10 and 11, the conical pilot 92 is a cylindrical opening having a diameter that is smaller than the largest diameter of the GCS The guiding pilot 102 in the illustrated example embodiment is an obround slot.

The rudder 94 in the illustrated example embodiment is geometrically shaped as a frustum and formed from hardened steel. In the illustrated example embodiment, the conical pilot 92 is first advanced into the centering pilot 100, followed by the rudder 94, independently advancing into the guiding pilot 102. In an alternative example embodiment, the rudder 94 is shaped the same as the conical pilot 92 and the pallet 22 includes an obround-slotted blind bole as the guiding pilot 102.

Figure 6:
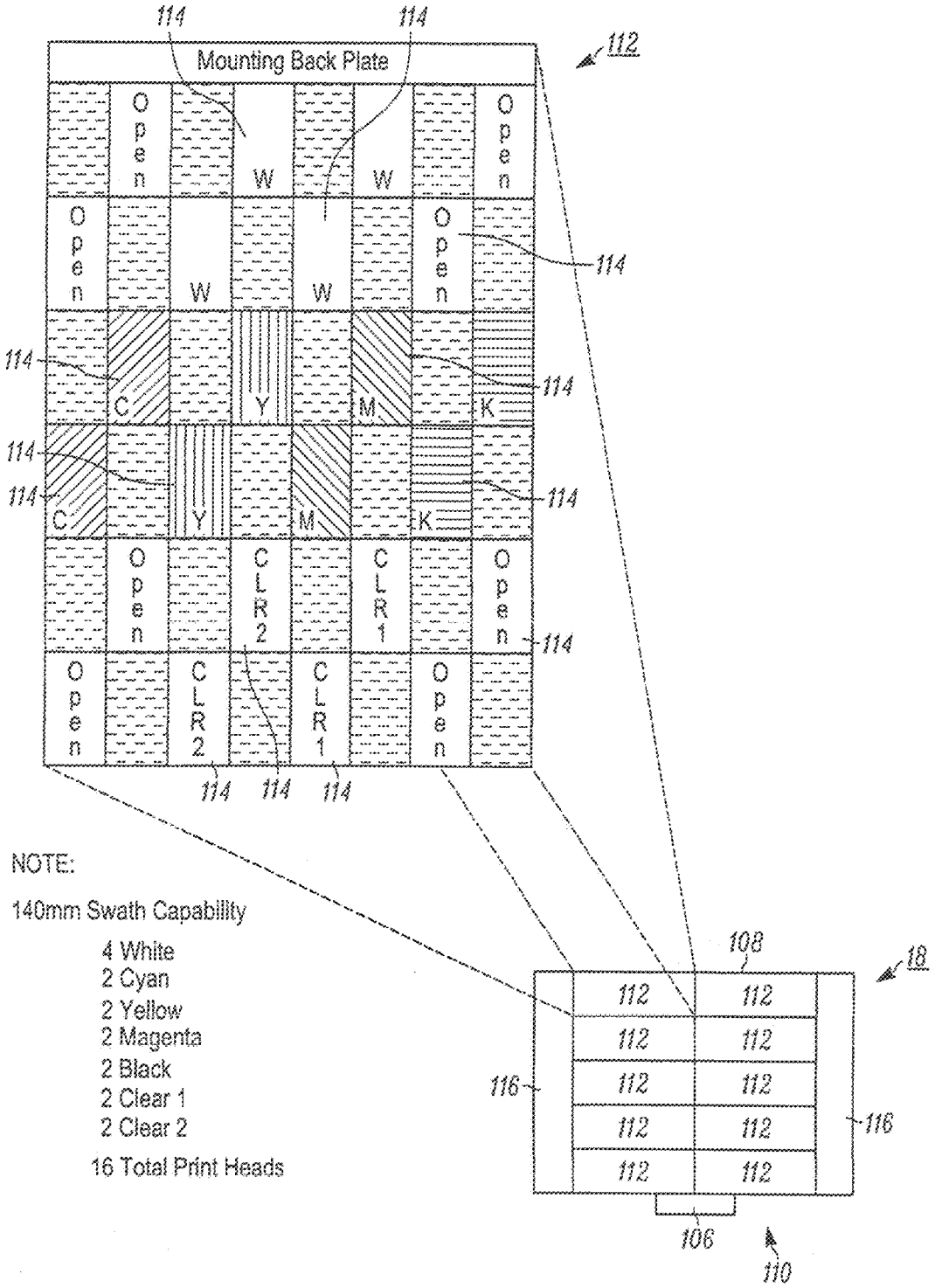
FIG. 6 illustrates a lower plan view of an application assembly in accordance with one example embodiment of the present disclosure.

Referring now to FIGS. 1 and 6, the application assembly 18 is illustrated in accordance with one example embodiment of the present disclosure. The application assembly 16 comprises a linear actuator 106 coupled to the catwalk 68 for movement along the lateral x-axis. The linear actuator 106 provides translation of the application assembly 18 along the z-axis, near and away from the media located on the pallets 22.

The linear actuator 106 at an end opposite the catwalk 68 is secured to a fixture 108 that supports on its underside a plurality of print heads 112 that includes a number of nozzles 114 for spraying on media 52 various designated ink colors, clear coats, and fluids 50. In the illustrated example embodiment of FIG. 6, the print head 112 includes nozzles with white, cyan, yellow, magenta, black and clear. However, it should be appreciated that the print head 112 can include any number of color/fluid combinations, such as solvent inks, clear coats, and the like without departing from the spirit of the claimed disclosure.

Along the lateral sides of the fixture 108 are pin lamps 116. The pin lamps solidify the fluid or ink 52 (or pin the ink) on the desired media 50 during operation of the system 10. In the illustrated example embodiment, the print heads 112 are manufactured by XAAR Corporation of the United Kingdom, sold under part number 1001.

In the example embodiments of FIGS. 1-6, the coupling design of the pallets 22 to the carriers 84, 86, the linear bearings of the first and second conveyors 80, 82, and the movement of the application assembly 18 advantageously allows the resolution of the ink's 52 positioning on the media 50 to be 720 dpi reliably or 1 pixel fluid placement, equating to 0.0014 inches with a tolerance of +/−0.00035 inches (or ¼ of one pixel). In addition to this resolution being achieved through the above design, it is also attributed from a constant velocity in the application assembly 18 in its movement back and forth as indicated by arrows W through the control system 14 and construct of the conveyance arrangement 16, applying fluid or ink 52, eliminating any blurring on the media 50. The spraying of ink or fluid 52 to reach the desired image on the media 50 includes in one example embodiment more than one pass/application by one or more print heads 112. The spraying of the fluid 52 in the illustrated example embodiment along both directions of the lateral axis x, followed by a first curing process by pin lamps 116 that set the fluid on the media 50, preventing runs or flooding of the fluid on the media.

During operation of the ink application system 10, the constant movement of the application assembly 18 back-and-forth along the lateral axis x and movement of pallets 22 through the system without interruption is achieved. Interruption is advantageously minimized because of the system's 10 design. In particular, the throughput operation at different stages is shown in FIGS. 7-10.

Figure 7:
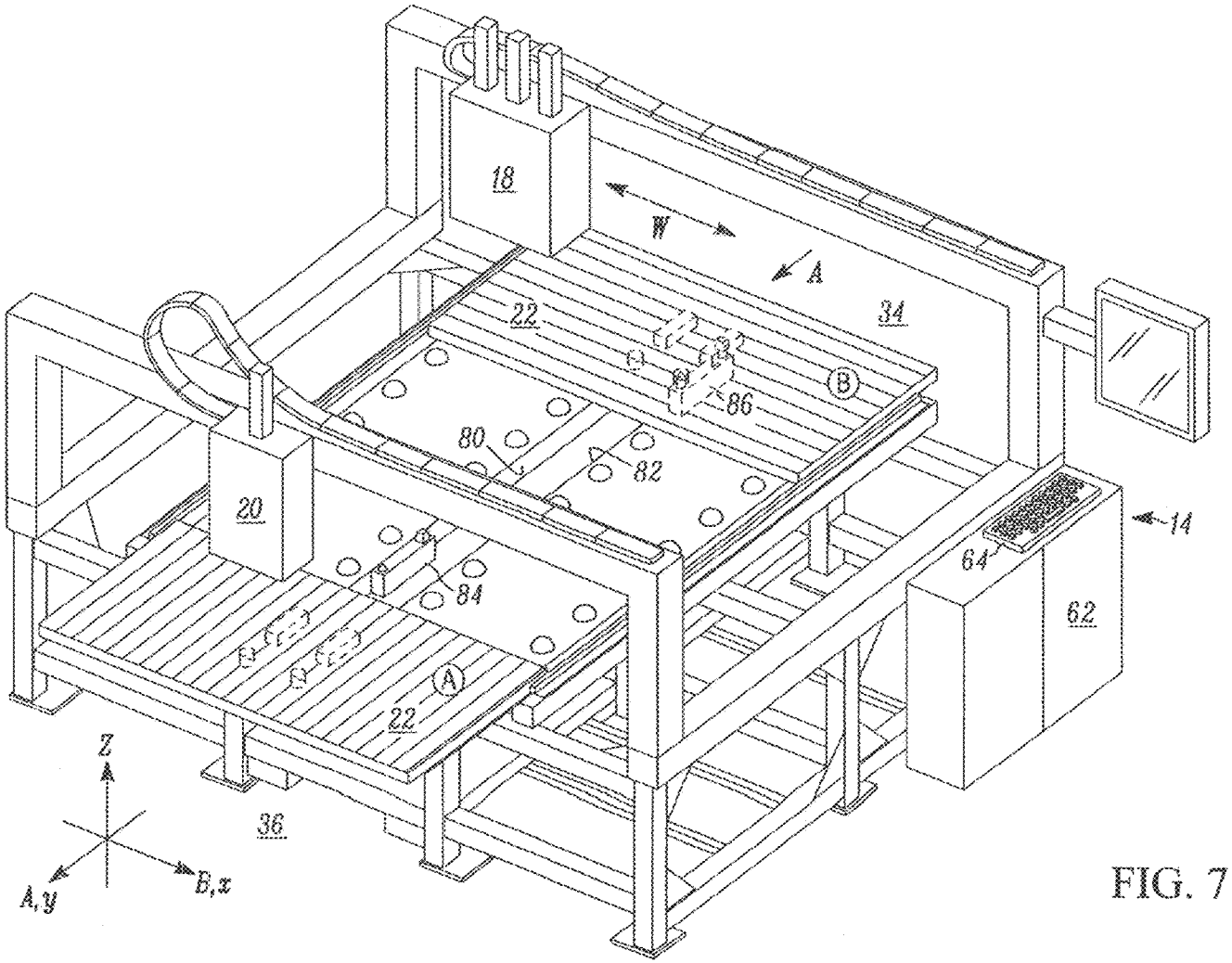
FIGS. 7-9 illustrate the flow of media and equipment through the application system in accordance with one example embodiment of the present disclosure.

In FIG. 7, pallet 22A and media 50 thereon is ready for removal from the system 10 by either manual or an automated process. Accordingly, the carrier 82 is decoupled from pallet 22A by retracting the linear actuator 91 to the retracted actuated position 98, then it is translated along the return path R by conveyor 80 for coupling to alternating pallet 22C by advancing the linear actuator 91 to the advance actuated position 96 into corresponding pilots 100/102 of the receiving pallet 22C. Pallet 22B is in FIG. 7 coupled to carrier 86 for controlled indexing advancement that continues while carrier 84 returns to the entry station 34. While the indexing and spraying occurs on pallet 22B, carrier 84 is actuated to the retracted actuated position, allowing for passage of carrier 84 below pallet 22B and for coupling to pallet 22C as it approaches the entry station 34 as shown in FIG. 8.

Figure 8:
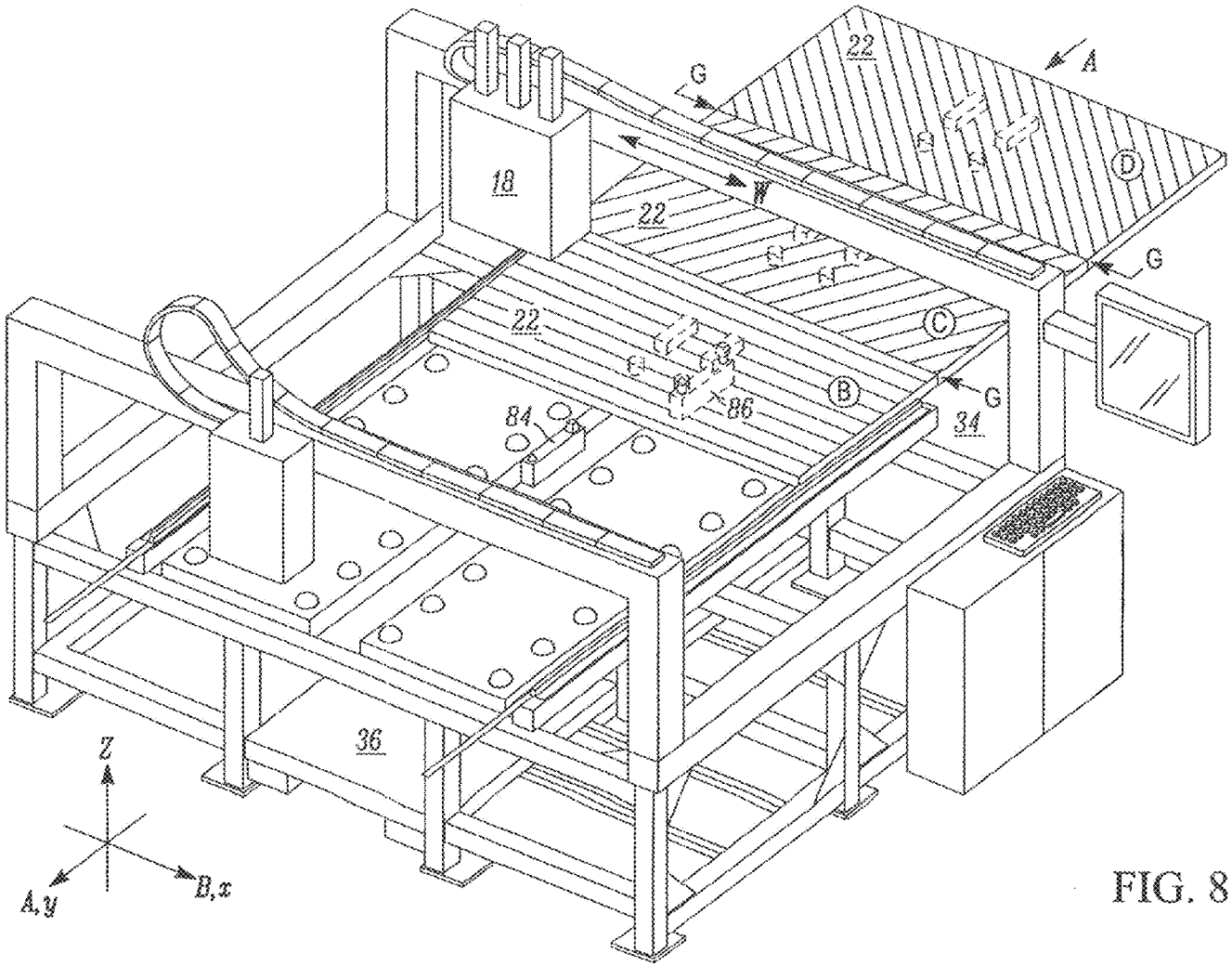
Figure 9:
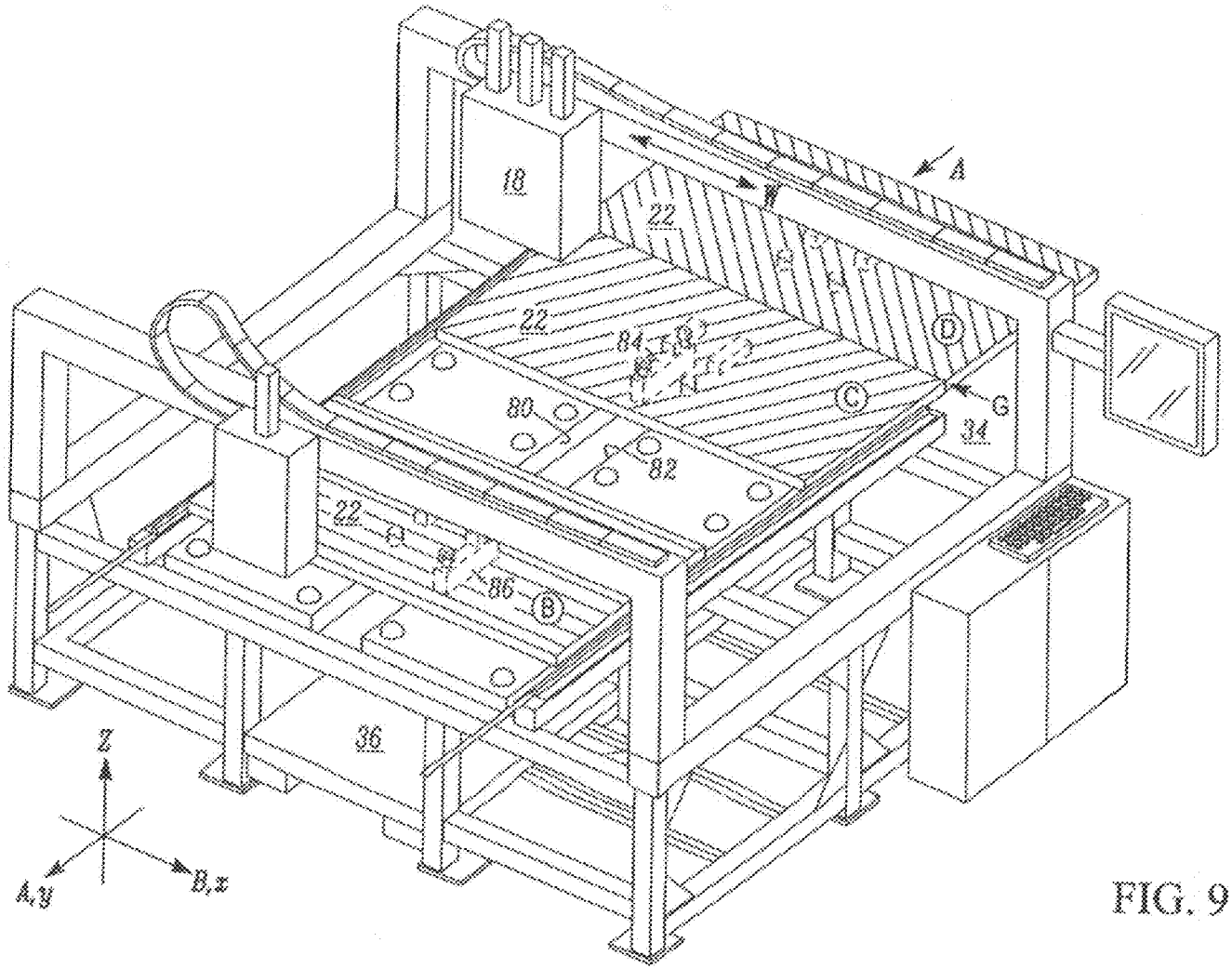

Once the ink 52 is applied to all desired media 50 on pallet 22B through movement and spraying of the application assembly 18 over several passes, the carrier 86 is continued to advance along the path of travel A by conveyor 82, but changes from a fluid or ink application velocity, to a faster unload speed until reaching exit station 36, as illustrated between FIGS. 8 and 9. In an alternative example embodiment, a second indexing advancement occurs while curing structure 20 passes over pallets 22 near the exit station.

In FIG. 9, carrier 84 advances pallet 22C at an indexing fluid application velocity along the path of travel A until the ink 52 is applied to all desired media on pallet 22 C through movement and spraying of the application assembly 18 over several passes. The carrier 84 continues to advance by conveyor 80, changing from an ink application velocity indexing speed, to a faster unload speed until reaching exit station 36.

While the carrier 84 advances pallet 22C in FIG. 9, carrier 86 will be decoupled from pallet 22B by retracting the linear actuator 91 to the retracted actuated position 98, then it is translated along the return path R under pallet 22C by conveyor 82 for coupling to alternating pallet 22D, returning to indexing station 34. That is, while the indexing and spraying occurs on pallet 22C, carrier 86 is actuated to the retracted actuated position, allowing for passage of carrier 86 below pallet 22C and for coupling to pallet 22D as it approaches the entry station 34 as shown in FIG. 9.

The throughput of the system 10 illustrates in FIGS. 7-9 that it is maximized by the minimizing the gaps G between pallets 22 with little or no interruption. In one example embodiment, the application assembly 18 as it moves back and forth spraying fluid 52 on the media 50 in the directions of arrows W along catwalk 68, the print heads 112 spray or apply fluid across multiple pallets 22 daring a single lateral pass in the direction of the x-axis, thus maximizing throughput of the system 10. The control system 14 is capable of turning on and off select nozzles 114 based on the media 50 and desired image passing through the system 10.

As used herein, terms of orientation and/or direction such as upward, downward, forward, rearward, upper, lower, inward, outward, inwardly, outwardly, horizontal, horizontally, vertical, vertically, distal, proximal, axially, radially, etc., are provided for convenience purposes and relate generally to the orientation shown in the Figures and/or discussed m the Detailed Description. Such orientation/direction terms are not intended to limit the scope of the present disclosure, this application and the invention or inventions described therein, or the claims appended hereto.

What have been described above are examples of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications, and variations that fall within the spirit and scope of the appended claims.

What is claimed is:

1. A ink dispensing system comprising:

a plurality of pallets for arranging a medium that receives ink during operation;

a support structure for guiding the plurality of pallets along a path of travel through an ink application system;

an application assembly for applying ink and energy to the medium arranged on the plurality of pallets, the application assembly translating during operation in an application direction transverse to the path of travel;

a conveyance arrangement comprising first and second conveyors extending to an entry station and an exit station of the ink dispensing system, each conveyor for transferring one of the plurality of pallets through the ink application system, each of the first and second conveyors having a dedicated carrier selectively coupled to one of the plurality of pallets during movement along the path of travel toward the exit station and selectively decoupled from the one of the plurality of pallets during movement of the dedicated carrier toward the entry station;

wherein the plurality of pallets further comprise a centering pilot and a guiding pilot recessed in an undercarriage surface of the pallets, the centering pilot comprises a conical recess ascending converging from an outer surface of the undercarriage toward an inner region of the pallets, the guiding pilot comprises an elongated slot in the undercarriage surface of the pallets;

and the first and second conveyors allowing for prescribed coupling and decoupling of each of the dedicated carriers with the centering and the guiding pilots of alternating pallets such that the ink is applied to the medium supported by the plurality of pallets without interruption during operation.

2. The ink dispensing system of claim 1 further comprising a controller for controlling the prescribed coupling and decoupling of said, dedicated carriers with said plurality of pallets and movement of the carriers along the first and second conveyors.

3. The ink dispensing system of claim 1 wherein the dedicated carriers further comprise a linear actuator for coupling and decoupling the dedicated carriers with the plurality of pallets, the linear actuator comprising a conical pilot for centering the pallets relative to the support structure and application assembly; the linear actuator further comprising a rudder for guiding lateral orientation of the pallets relative to the conical pilot.

4. The ink dispensing system of claim 3 wherein the conical pilot and rudder extend when advance actuated translate to a first level for engaging an undercarriage of the plurality of pallets and when retract actuated translate to a second level for passing below the undercarriage of said plurality of pallets.

5. The ink dispensing system of claim 1 wherein the dedicated carriers further comprise a linear actuator for coupling and decoupling the dedicated carriers with the plurality of pallets, the linear actuator comprising a conical pilot for centering the pallets relative to the support structure and application assembly; the linear actuator further comprising a conical rudder for guiding lateral orientation of the pallets relative to the conical pilot, further wherein the conical pilot engages said centering pilot at an annular point of contact along an annular conical surface of the conical pilot and centering pilot and the conical rudder engages said guiding pilot at least one point of contact along an annular conical surface of the conical rudder and guiding pilot.

6. A ink dispensing system comprising:

a plurality of pallets for arranging a medium that receives ink during operation;

a support structure for guiding the plurality of pallets along a path of travel through an ink application system;

an application assembly for applying ink and energy to the medium arranged on the plurality of pallets, the application assembly translating during operation in an application direction transverse to the path of travel; and a conveyance arrangement comprising first and second conveyors, each for transferring one of the plurality of pallets through the ink application system, each of the first and second conveyors having a dedicated carrier having first and second projections that are selectively coupled to one of the plurality of pallets during movement along a first direction of the path of travel and selectively decoupled from the one of the plurality of pallets during movement of the dedicated carrier along a second direction of the path of travel, wherein the plurality of pallets further comprise first and second connection locations recessed in an undercarriage surface of the pallets for receipt of the first and second projections during pallet movement in the first direction.

7. The ink dispensing system of claim 6 further wherein the first and second conveyors further comprise extending to an entry station and an exit station of the ink dispensing system, allowing for prescribed coupling and decoupling of the dedicated carriers with alternating pallets such that the ink is applied to the medium supported by the plurality of pallets without interruption during operation, and further wherein the pallets include first and second connection locations comprising a centering pilot and a guiding pilot recessed in the undercarriage surface of said pallets, the centering pilot comprises a cylindrical recess ascending from an outer surface of the undercarriage toward an inner region of the pallets.

8. The ink dispensing system of claim 7 further comprising a controller for controlling the prescribed coupling and decoupling of the dedicated carriers with said plurality of pallets and movement of said dedicated carriers along said first and second conveyors.

9. The ink dispensing system of claim 6 wherein the plurality of pallets comprise a centering pilot and a guiding pilot recessed in an undercarriage surface of the pallets, the centering pilot comprises a conical recess ascendingly converging from an outer surface of the undercarriage toward an inner region of the pallets, the guiding pilot comprises an elongated slot in the undercarriage surface of the pallets.

10. The ink dispensing system of claim 9 wherein the projections of the dedicated carriers comprise a conical pilot for centering the pallets relative to the support structure and application assembly; a rudder for guiding lateral orientation of the pallets relative to the conical pilot; and wherein the dedicated carriers further comprise a linear actuator that couples and decouples the conical pilot and rudder with the plurality of pallets.

11. The ink dispensing system of claim 10 wherein the conical pilot and rudder extend into the centering pilot and the guiding pilot when advance actuated translate to a first level for engaging an undercarriage of the plurality of pallets and when retract actuated translate to a second level for passing below the undercarriage of the plurality of pallets.

12. The ink dispensing system of claim 6 wherein the plurality of pallets further comprise a centering pilot and a guiding pilot recessed in an undercarriage surface of the pallets, the centering pilot comprises a cylindrical recess ascending from an outer surface of the undercarriage toward an inner region of the pallets, the guiding pilot comprises an elongated slot ascending from the outer surface of the undercarriage toward the inner region of the pallets, wherein the dedicated carriers further comprise a linear actuator for coupling and decoupling the dedicated carriers with the plurality of pallets, the linear actuator comprising a conical pilot for centering the pallets relative to the support structure and application assembly; the linear actuator further comprising a conical rudder for guiding lateral orientation of the pallets relative to the conical pilot, further wherein the conical pilot engages said centering pilot at an annular point of contact along an annular conical surface of the conical pilot and centering pilot and the conical rudder engages the guiding pilot at least one point of contact along an annular conical surface of the conical rudder and guiding pilot.

13. A ink dispensing system comprising:

a support structure for guiding a plurality of pallets along a path of travel through the ink dispensing system, the plurality of pallets for arranging a medium that receives ink during operation;

an application assembly for applying ink to the medium arranged on the plurality of pallets, the application assembly translating during operation in an application direction transverse to the path of travel;

a conveyance arrangement comprising first and second conveyors, each for transferring one of said plurality of pallets through the ink dispensing system, the first and second conveyors each having dedicated carriers, wherein a dedicated carrier of the dedicated carriers is selectively coupled to one of the plurality of pallets during movement along a first direction of the path of travel and selectively decoupled from the one of the plurality of pallets during movement of the dedicated carrier along a second direction of the path of travel;

the first and second conveyors further comprising extending to an entry station and an exit station of the ink dispensing system, allowing for prescribed coupling and decoupling of each of the dedicated carriers with alternating pallets such that the ink is applied to the medium supported by the plurality of pallets without interruption during operation;

wherein the dedicated carriers further comprise a linear actuator for coupling and decoupling the dedicated carriers with the plurality of pallets.

14. The ink dispensing system of claim 13 further comprising a controller for controlling said prescribed coupling and decoupling of the dedicated carriers with said plurality of pallets and controlling movement of the carriers along the first and second conveyors.

15. The ink dispensing system of claim 13 wherein the recesses in the plurality of pallets comprise a centering pilot and a guiding pilot recessed in the undercarriage surface of the pallets, the centering pilot comprises a conical recess ascending converging from an outer surface of the undercarriage toward an inner region of the pallets, the guiding pilot comprises an elongated slot in the undercarriage surface of the pallets.

16. The ink dispensing system of claim 15 wherein the linear actuator comprises a conical pilot for centering the pallets relative to the support structure and application assembly; the linear actuator further comprising a rudder for guiding lateral orientation of the pallets relative to the conical pilot.

17. The ink dispensing system of claim 16 wherein the conical pilot and rudder extend when advance actuated translate to a first level for engaging an undercarriage of the plurality of pallets and when retract actuated translate to a second level for passing below the undercarriage of the plurality of pallets.

18. The ink dispensing system of claim 13 wherein the recesses in the plurality of pallets comprise a centering pilot and a guiding pilot recessed in the undercarriage surface of the pallets, said centering pilot comprises a cylindrical recess ascending from an outer surface of the undercarriage toward an inner region of the pallets, the guiding pilot comprises an elongated slot ascending from the outer surface of the undercarriage toward the inner region of the pallets, wherein the linear actuator comprising a conical pilot for centering the pallets relative to the support structure and application assembly; and the linear actuator further comprising a conical rudder for guiding lateral orientation of the pallets relative to the conical pilot, further wherein the conical pilot engages the centering pilot at an annular point of contact along an annular conical surface of the conical pilot and centering pilot and the conical rudder engages the guiding pilot at least one point of contact along an annular conical surface of the conical rudder and guiding pilot.

19. An inkjet system comprising:

a plurality of pallets for supporting a medium that receives ink during operation;

a support structure for guiding the plurality of pallets along a path of travel through the inkjet system from an entry station to an exit station;

an application assembly for applying the ink to the medium arranged on the plurality of pallets, the application assembly translating during operation in an application direction transverse to the path of travel;

a conveyance arrangement comprising:

first and second elongated, side by side conveyors, extending from the entry station to the exit station for transferring the plurality of pallets through the inkjet system, and first and second dedicated carriers supported by respective ones of the first and second conveyors for selective coupling to the plurality of pallets during movement away from the entry station along a first direction of the path of travel and selectively decoupling from the plurality of pallets to allow unloading of pallets from the exit station of the inkjet system and movement of a dedicated carrier uncoupled from a pallet along a second direction of the path of travel back to the entry station;

each pallet comprising first and second connection locations that engage one or the other of the first and second dedicated carriers during movement of the pallet along the first direction.

20. The inkjet system of claim 19 comprising a control system for alternately coupling and decoupling the first and second dedicated carriers to a succession of the plurality of pallets for movement through the inkjet system.

21. An inkjet system of claim 19 wherein the first and second connection locations comprise recesses in a bottom of the pallets and wherein the first and second dedicated carriers comprise projections which enter the recesses to couple the dedicated carriers to the pallets.

22. The inkjet system of claim 21 wherein the side by side conveyors cause the dedicated carriers to move at different speeds based on where the dedicated carriers are in the path of travel.

* * * * *